US005406040A

United States Patent [19]

Johnson

[11] Patent Number: 5,406,040

[45] Date of Patent: Apr. 11, 1995

[54] JOYSTICK WITH IMPROVED ACTUATOR

[75] Inventor: Charlie H. Johnson, Chicago, Ill.

[73] Assignee: Wico Corporation, Niles, Ill.

[21] Appl. No.: 164,261

[22] Filed: Dec. 9, 1993

[51] Int. Cl.[6] ..... H01H 25/04

[52] U.S. Cl. ..... 200/6 A; 200/4

[58] Field of Search ..... 200/4, 5 R, 6 R, 6 A, 200/16 R, 17 R, 18

[56] References Cited

U.S. PATENT DOCUMENTS 3,115,555 12/1963 Lescarboura ..... 200/5

5,068,498 11/1991 Engel ..... 200/6 A

OTHER PUBLICATIONS

WICO Catalog p. 496 (1993).

HAPP Controls, Inc. catalog pg.

*Primary Examiner*—A. D. Pellinen

*Assistant Examiner*—Michael A. Friedhofer

*Attorney, Agent, or Firm*—Emrich & Dithmar

[57] ABSTRACT

A joystick includes a shaft having a handle at one end and an actuator at the other end and pivotally mounted on a base for universal pivotal movement to actuate a plurality of switches. A bearing sleeve having a very low coefficient of friction is telescopically disposed between the shaft and the actuator coaxial with each and freely rotatable relative to each so that the actuator is substantially unresponsive to rotational movements of the shaft about its axis. The actuator is trapped between a flange on the bearing sleeve and an E-clip on the end of the shaft, the clip also retaining the bearing sleeve on the shaft.

14 Claims, 1 Drawing Sheet

13
40
10
35
19
11
18
29
16
15
21
20
31
25
23
36
55
1/3

35
39
36
43
35A
41
42
44
30
34
33
31
48
47
45
46
49
53
54
50
52
55

35
38
43
41
34
44
33
31
20
32
48
45
46
47
53
54
52
51
49
55
36

40
37
35
19
18
11
34
38
43
14
12
30
15
16
41
17
13
31
44
33
20
21
24
32
23
47
28
25
26
51
45
55
36
50
4
5

11
16
17
13
35
12
34
15
44

20
26
52
27
25
36
55
51
50

JOYSTICK WITH IMPROVED ACTUATOR

BACKGROUND OF THE INVENTION

1. Field of the Invention

The present invention relates to joysticks, which are control devices which include a universally pivotable shaft for actuating a plurality of switches to control associated electronic equipment, such as the movement of a cursor on a computer screen.

2. Description of the Prior Art

Joysticks typically include an elongated shaft universally pivotally mounted on a base structure which carries a plurality of switches. One end of the shaft carries an actuator which responds to pivotal movements of the shaft to actuate one or more of the switches. One such prior joystick is manufactured by Wico Corporation under part no. 159844. In that prior joystick the actuator has a tubular portion which telescopically fits over the actuating end of the shaft and is retained in place by a clip, which bears against the distal end of the actuator and clamps it against a bushing on the shaft, thereby axially to position the actuator for proper actuation of the switches.

One problem with the prior Wico joystick and other similar joysticks is that, when used for controlling certain computer programs, such as certain sophisticated video games, rapid and frequent movements of the handle are necessary. While pivotal movements are required to operate the joystick and effect actuation of the switches, the user also frequently inadvertently rotates the handle shaft about its axis. Because the actuator is clamped in place on the shaft, it tends to rotate with the shaft, and these rotational movements may be sufficient to inadvertently actuate one or more of the switches, resulting in spurious control signals.

SUMMARY OF THE INVENTION

It is a general object of the invention to provide an improved joystick which avoids the disadvantages of prior joysticks while affording additional structural and operating advantages.

An important feature of the invention is the provision of a joystick which is accurately responsive only to pivotal movements of the joystick shaft.

In connection with the foregoing feature, a further feature of the invention is the provision of a joystick of the type set forth, which is substantially unresponsive to rotational movements of the joystick shaft about its axis.

A further feature of the invention is the provision of a joystick of the type set forth which is of relatively simple and economical construction.

These and other features of the invention are attained by providing in a joystick including a base, a plurality of switches arranged on the base, an elongated shaft having a handle end and an actuator end and a longitudinal axis extending therebetween, and a pivot mounting assembly supporting the shaft on the base for universal pivotal movement about a pivot point on the shaft axis for controlling actuation of the switches, the improvement comprising: a bearing member carried by the actuator end of the shaft and freely rotatable relative thereto about the shaft axis, an actuator member carried by the bearing member and freely rotatable relative thereto about the shaft axis so as to be substantially unresponsive to rotation of the shaft about its axis, and retaining means axially positioning the actuator member on the shaft for actuating engagement with the switches in response to pivotal movement of the shaft.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
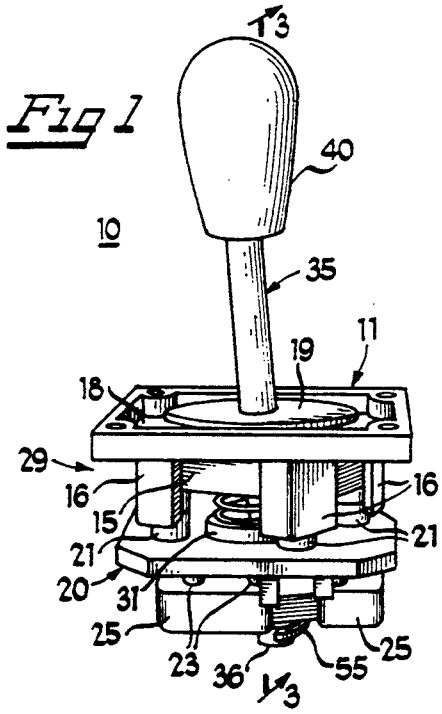
FIG. 1 is a front perspective view of a joystick constructed in accordance with and embodying the features of the present invention.
Figure 3:
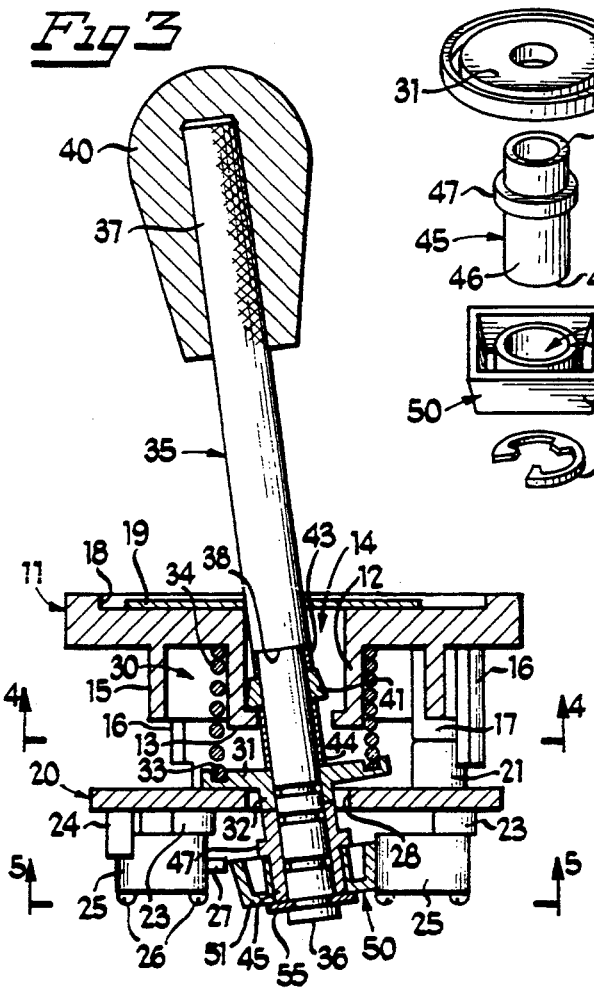
FIG. 3 is an enlarged view in vertical section taken along the line 3—3 in FIG. 1.
Figure 4:
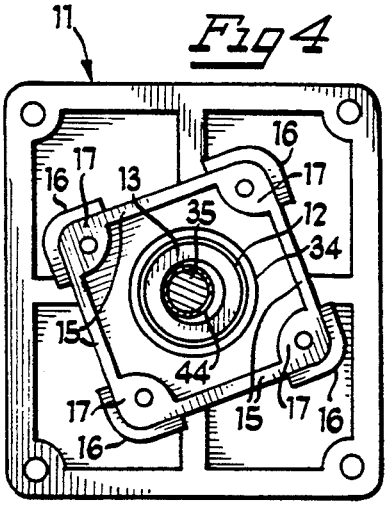
FIG. 4 is a view in horizontal section taken along the line 4—4 in FIG. 3.

Referring to FIGS. 1, 3, and 4 of the drawings, there is illustrated a joystick, generally designated by the numeral 10, constructed in accordance with and embodying the features of the present invention. The joystick 10 includes a cover plate 11 and a mounting plate 20 joined together to form a base structure 29. The cover plate 11 is in the form of a flat, substantially square plate provided centrally thereof with a depending, circularly cylindrical, hollow turret 12 provided at its distal end with a radially inwardly extending annular lip 13. The turret 12 is coaxial with a circular bore 14 formed through the cover plate 11 for communication therewith. Also depending from the cover plate 11 are four side walls 15 arranged in a square configuration which is concentric with but rotated at a slight angle with respect to the cover plate 11. Integral with the side walls 15 at the corners of the square configuration are corner sections 16 which depend below the side walls 15. Integral with the side walls 15 at the insides of the corners thereof are lugs 17. Formed in the outer or upper surface of the cover plate 11 is a recess 18 in which is received a washer 19.

Figure 5:
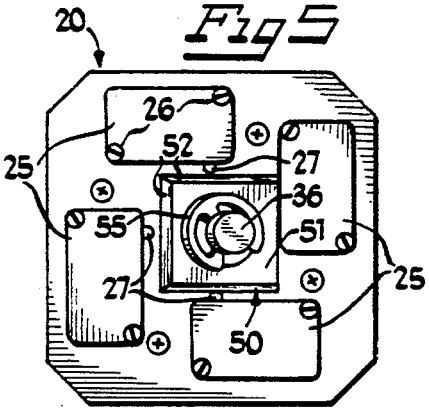
FIG. 5 is a view in horizontal section taken along the line 5—5 in FIG. 3.

Referring also to FIGS. 5 the mounting plate 20 is substantially square in shape with beveled corners and is provided at the upper surface thereof with four upstanding lugs 21 and is provided at the lower surface thereof with a plurality of depending pedestals 23. The pedestals 23 are arranged in groups of four, with each group of four being adapted for supporting thereon a microswitch 25, such that at least two of the pedestals 23 of each group are disposed respectively adjacent to corners of the associated microswitch 25 and are integral with corner sections 24 which depend downwardly below the pedestals 23 for wrapping around the corners of the associated microswitch 25. Preferably, four of the microswitches 25 are provided, each being fixedly secured to the associated pedestals 23 by suitable screws 26 (see FIGS. 3 and 5). Each of the microswitches 25 is provided with an actuator finger 27 which projects inwardly toward the center of the mounting plate 20. The mounting plate 20 is provided with a circular bore 28 formed centrally therethrough (FIG. 3). In assembly, the lugs 21 of the mounting plate 20 are respectively butted against the lugs 17 of the cover plate 11 and are fixedly secured together by suitable screws (not shown). It will also be appreciated that the cover plate 11 may, in turn, be fixedly secured to an associated housing or other support structure (not shown) by means of suitable screws passed through associated openings, respectively disposed at the corners of the cover plate 11.

Figure 2:
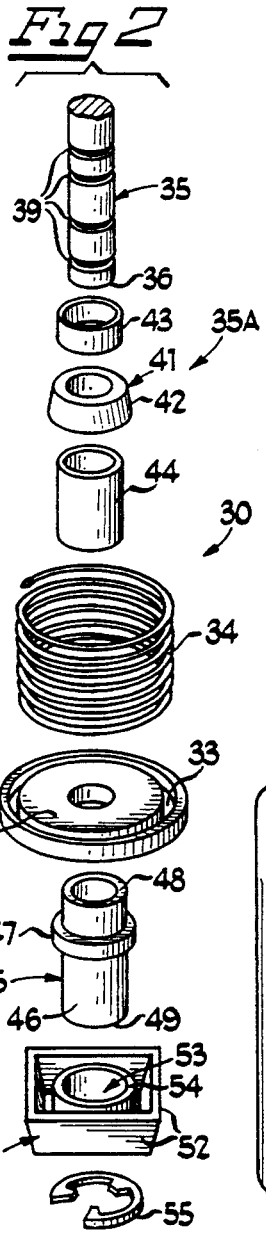
FIG. 2 is an enlarged, fragmentary, exploded view of the shaft assembly of the joystick of FIG. 1.
Figure 6:
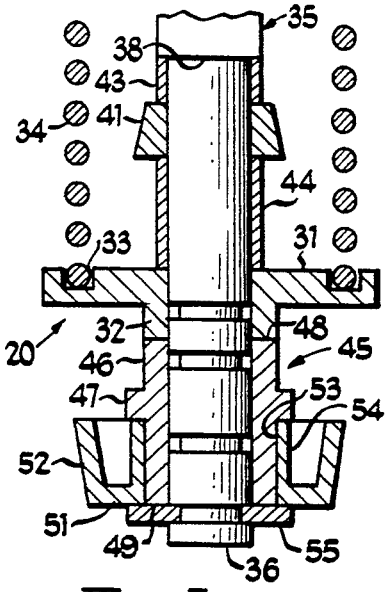
FIG. 6 is an enlarged, fragmentary, sectional view of the actuator end of the shaft assembly of FIG. 3.

Referring also to FIGS. 2 and 6, the joystick 10 also includes a pivot mounting assembly 30, which includes a circular washer 31 having a cylindrical central hub portion 32 depending therefrom, and provided in its upper surface with an annular groove 33. The washer 31 has a diameter substantially greater than the diameter of the bore 28 through the mounting plate 20 and is disposed in use on the mounting plate 20 with the hub portion 32 extending downwardly through the bore 28. There is also provided a helical compression spring 34 which has the upper end thereof telescopically received around the hollow turret 12 of the cover plate 11 and has the lower end thereof seated in the groove 33 of the washer 31, resiliently to urge the washer 31 against the mounting plate 20. Preferably, the washer 31 is formed of a suitable plastic material and is slightly flexible and resilient.

The joystick 10 also includes a shaft assembly 35A, which includes an elongated metal shaft 35 having an actuator end 36 and a slightly enlarged-diameter handle end 37 separated by an annular shoulder 38. Axially spaced apart along the actuator end 36 of the shaft 35 are a plurality of circumferential grooves 39 for accommodating different actuator arrangements, so that the shaft 35 can be used with different joystick configurations. An enlarged handle 40 is fixedly secured by suitable means to the handle end 37 of the shaft 35. Received around the actuator end 36 of the shaft 35 is a pivot bushing 41, which has a frustoconical outer side surface 42, and which is disposed between a short bushing 43 and a longer bushing 44, the bushings 41, 43 and 44 being assembled so that the short bushing 43 is disposed against the shoulder 38. The bore through the washer 31 has a diameter very slightly greater than that of the actuator end 36 of the shaft 35, but less than the outer diameter of the long bushing 44, so that the bushings 41, 43 and 44 are trapped between the shoulder 38 and the washer 31, as illustrated in FIG. 3. When the shaft 35 is thus inserted as far as possible in the washer 31, the pivot bushing 41 will be disposed within the turret 12 of the cover plate 11, the maximum outer diameter of the pivot bushing 41 being greater than the diameter of the bore through the turret lip 13 to limit the depth of insertion of the shaft 35 in the pivot mounting assembly 30.

The shaft assembly 35A also includes a cylindrical bearing sleeve 45 having a circularly cylindrical outer surface 46 with a diameter substantially the same as that of the outer surface of the washer hub portion 32. The bearing sleeve 45 fits telescopically over the actuator end 36 of the shaft 35. The bearing sleeve 45 has an inner end surface 48 which abuts against the washer hub portion 32 and an outer end surface 49. Extending radially outwardly from the bearing sleeve 45 somewhat closer to the inner end surface 48 than to the outer end surface 49 is an annular flange 47. The bearing sleeve 45 is so dimensioned that when it is fitted over the shaft 35 it is freely rotatable with respect thereto about the axis thereof. Preferably, the bearing sleeve 45 is formed of a plastic material having a relatively low coefficient of friction, such as nylon.

The shaft assembly 35A also includes an actuator 50 which has a substantially square end wall 51 integral along the four sides thereof with four upstanding and outwardly sloping, generally trapezoidal side walls 52. Formed centrally through the end wall 51 is a circular bore 53 which communicates with a circularly cylindrical tube 54 which is integral with the end wall 51 and projects outwardly therefrom in the same direction as the side walls 52.

The inner diameter of the bore 53 and the tube 54 is such that they fit telescopically over the distal end of the bearing sleeve 45 coaxially therewith and so as to be freely rotatable with respect thereto about the axis thereof. The length of the actuator tube 53 is preferably slightly less than the distance between the flange 47 and the outer end surface 49 of the bearing sleeve 45.

In assembly, the bushings 41, 43 and 44 are fitted over the actuator end 36 of the shaft 35 and that end is then inserted through the turret 12 of the cover plate 11 and through the washer 31 until the pivot bushing 41 abuts the annular lip 13 of the turret 12. The bearing sleeve 45 is then fitted over the actuator end 36 of the shaft 35 and the actuator 50 is fitted over the bearing sleeve 45 until it abuts the flange 47. Then, a retaining E-clip 55 is snapped over the actuator end 36 of the shaft 35 outboard of the bearing sleeve 45 and the actuator 50 to retain the shaft assembly 35A in its assembled condition.

Preferably, the parts are so dimensioned and arranged that, in order to mount the E-clip 55 in place, it will be necessary to push the actuator 50, the bearing sleeve 45 and the washer 31 axially inwardly, slightly compressing the spring 34. Thus, the bearing sleeve 45 will be resiliently held firmly against the E-clip 55 in the assembled condition. If desired, the parts may be arranged so that the E-clip 55 fits into one of the grooves 39 on the shaft 35. The outer diameter of the E-clip 55 is greater than the diameter of the bore 53 in the actuator 50, so that it also serves to cooperate with the bearing sleeve flange 47 to axially position the actuator 50 in the desired location relative to the switches 25. However, because the tube 54 is shorter than the distance between the flange 47 and the outer surface 49 of the bearing sleeve 45, the E-clip 55 will not clamp the actuator 50 and the actuator 50 will remain freely rotatable relative to the bearing sleeve 45.

As can be seen from FIGS. 3 and 5, when thus assembled the parts are so dimensioned and arranged that, when the shaft 35 is pivoted about a universal pivot point, which lies along its axis generally in the plane of the mounting plate 20, it will engage and depress one or two of the switch actuator fingers 27 for actuating the associated microswitches 35, all in a known manner. However, because the bearing sleeve 45 is freely rotatable with a low coefficient of friction relative to both the shaft 35 and the actuator 50, the actuator 50 will remain substantially unresponsive to rotational movements of the shaft 35 about its axis. Thus, such rotation of the shaft 35 will not result in actuation of any of the microswitches 25.

In a constructional model of the invention, the shaft 35 is made of a suitable metal, such as steel, the pivot bushing 41 is formed of a suitable plastic material, such as that sold under the trade name ZYTEL, the bushings 43 and 44 may be formed of a suitable metal, the cover plate 11 and the mounting plate 20 may be formed of ZYTEL, while the washer 31, the bearing sleeve 45 and the actuator 50 may be formed of nylon.

From the foregoing, it can be seen that there has been provided an improved joystick which is accurately responsive to universal pivotal movements of the joystick shaft while remaining substantially unresponsive to the rotational movements of the shaft about its axis.

I claim:

1. In a joystick including a base, a plurality of switches arranged on the base, an elongated shaft having an handle end and an actuator end and a longitudinal axis extending therebetween, and a pivot mounting assembly supporting the shaft on the base for universal pivotal movement about a pivot point on the shaft axis for controlling actuation of the switches, the improvement comprising: a bearing member carried by the actuator end of the shaft and freely rotatable relative thereto about the shaft axis, an actuator member non-circular in transverse cross section carried by said bearing member and freely rotatable relative thereto about the shaft axis so as to be substantially unresponsive to rotation of the shaft about its axis, and retaining means axially positioning said actuator member on the shaft for actuating engagement with the switches in response to pivotal movement of the shaft.

2. The joystick of claim 1, wherein said bearing member is a tubular sleeve telescopically received over the actuator end of the shaft coaxially therewith.

3. The joystick of claim 2, wherein said actuator member includes a tubular portion telescopically received over said bearing member coaxially therewith.

4. The joystick of claim 1, wherein said bearing member is formed of a material having a very low coefficient of friction.

5. The joystick of claim 1, wherein said retaining means includes a clip engageable with the actuator end of the shaft.

6. The joystick of claim 5, wherein said clip is dispose axially outboard of said bearing member and said actuator member for engagement with each.

7. The joystick of claim 1, wherein said retaining means includes a flange on said bearing member engageable with said actuator member for limiting movement of said actuator member axially of the shaft away from the actuator end thereof.

8. In a joystick including a base, a plurality of switches arranged on the base, an elongated shaft having a handle end and an actuator end and a longitudinal axis extending therebetween, and a pivot mounting assembly supporting the shaft on the base for universal pivotal movement about a pivot point on the shaft axis for controlling actuation of the switches, the improvement comprising: a bearing member carried by the actuator end of the shaft, a retainer carried by the shaft axially outboard of said bearing member for preventing removal of said bearing member from the actuator end of the shaft, bias means resiliently urging said bearing member against said retainer,a positioning flange on said bearing member, an actuator member non-circular in transverse cross section carried by said bearing member between said flange and said retainer and positioned thereby for actuating engagement with the switches in response to pivotal movement of the shaft, said actuator member being freely rotatable relative to said bearing member about the axis of the shaft so as to be substantially unresponsive to rotational movement of the shaft about its axis.

9. The joystick of claim 8, wherein said bearing member is a tubular sleeve telescopically received over the actuator end of the shaft coaxially therewith.

10. The joystick of claim 9, wherein said actuator member includes a tubular portion telescopically received over said bearing member coaxially therewith.

11. The joystick assembly of claim 8, wherein said bearing member is formed of a material having a very low coefficient of friction.

12. The joystick of claim 8, wherein said retainer is removably mounted on the shaft.

13. The joystick of claim 12, wherein said retainer comprises an E-clip engageable with the shaft adjacent to the actuator end thereof.

14. The joystick of claim 8, and further comprising positioning means carried by the shaft and cooperating with said retainer for axially positioning said bearing member on the shaft.

* * * * *